US006217292B1

(12) United States Patent
Ota et al.

(10) Patent No.: US 6,217,292 B1
(45) Date of Patent: Apr. 17, 2001

(54) VARIABLE DISPLACEMENT TYPE REFRIGERANT COMPRESSOR

(75) Inventors: Masaki Ota; Taku Adaniya; Hirotaka Kurakake; Kenta Nishimura, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/318,889

(22) Filed: May 26, 1999

(30) Foreign Application Priority Data

May 27, 1998 (JP) ..... 10-145961

(51) Int. Cl.[7] ..... F04B 1/26
(52) U.S. Cl. ..... 417/222.2; 251/61.3; 137/907
(58) Field of Search ..... 417/222.2, 222; 137/907; 251/61.3

(56) References Cited

U.S. PATENT DOCUMENTS

| | | | | |
|---|---|---|---|---|
| 4,108,197 | * | 8/1978 | Brakebill | 251/61.3 |
| 4,688,997 | | 8/1987 | Suzuki et al. | 417/222 |
| 4,702,677 | * | 10/1987 | Takenaka et al. | 417/222 |
| 4,732,544 | * | 3/1988 | Kurosawa et al. | 417/222 |
| 5,092,741 | * | 3/1992 | Taguchi | 417/222 |
| 5,613,836 | | 3/1997 | Takenaka et al. | 417/222.2 |
| 5,681,150 | * | 10/1997 | Kawaguchi et al. | 417/222.2 |
| 6,062,824 | * | 5/2000 | Kimura et al. | 417/222.2 |
| 6,105,928 | * | 8/2000 | Ise et al. | 417/222.2 |

FOREIGN PATENT DOCUMENTS

| | | |
|---|---|---|
| 0 536 989 A1 | 4/1993 | (EP) . |
| 2 019 043 | 10/1979 | (GB) . |

OTHER PUBLICATIONS

EP 99 10 9303 Search Report dated Jan. 14, 2000.

* cited by examiner

*Primary Examiner*—Timothy S. Thorpe
*Assistant Examiner*—Cheryl J. Tyler
(74) *Attorney, Agent, or Firm*—Woodcock Washburn Kurtz Mackiewicz & Norris LLP

(57) ABSTRACT

A variable displacement type refrigerant compressor including a compressor housing having internally a compressing mechanism for compressing a refrigerant, a displacement varying mechanism for adjustably varying an amount of the refrigerant compressed and discharged by the compressing mechanism, and a displacement control valve unit controlling the operation of the displacement varying mechanism, which is an assembly of a pressure sensing mechanism formed by a flanged bellows element, a valve element, a valve seat having a port cooperating with the valve element, and a valve rod engaging the pressure sensing mechanism with the valve element, and are assembled by using a fixing screw member and a jig tool in position in a pressure sensing chamber, a valve chamber, and a valve rod bore coaxially formed in the compressor housing by drilling or boring from two sides of the compressor housing. The flanged bellows element of the displacement control valve unit is fixed in the pressure sensing chamber via the flange thereof by being threadedly engaged in the pressure sensing chamber.

11 Claims, 4 Drawing Sheets

VARIABLE DISPLACEMENT TYPE REFRIGERANT COMPRESSOR

BACKGROUND OF THE INVENTION

1. Field of the Invention

The present invention relates generally to a variable displacement type refrigerant compressor. More particularly, the present invention relates to a variable displacement refrigerant compressor accommodating therein a novel displacement control valve, which can be easily and accurately assembled in a compressor housing and can be an inexpensive mechanical element. The present invention further relates to a method of assembling the novel displacement control valve in the compressor housing.

2. Description of the Related Art

U.S. Pat. No. 4,688,997 discloses a typical variable displacement type refrigerant compressor adapted to be incorporated in a vehicle climate control system. The variable refrigerant compressor has a compressor housing in which a suction chamber, a discharge chamber, a crank chamber, a reciprocating piston mechanism to compress a refrigerant in a cylinder bore, a piston actuating mechanism including a cam plate mounted around a drive shaft to convert the rotation of the drive shaft in the reciprocation of the piston mechanism, and a displacement control valve unit, are mounted.

The displacement control valve unit of the refrigerant compressor of U.S. Pat. No. 4,688,997 includes a fluid supply passage extending from the discharge chamber to the crank chamber to supply a refrigerant at a high pressure into the crank chamber, a valve unit arranged in a portion of the fluid supply passage to open and close the portion of the fluid supply passage, a fluid withdrawal passage extending from the crank chamber to the suction chamber to maintain a constant fluid communication between both chambers, and a valve control mechanism to control the opening and closing operation of the valve unit. Namely, the valve control mechanism operates in such a manner that when the pressure in the crank chamber is reduced to below a predetermined reference value, it operates the valve unit to move to its open position where the refrigerant at a high pressure is supplied from the discharge chamber into the crank chamber. Further, when the pressure in the crank chamber goes up beyond the predetermined reference value, the valve control mechanism operates the valve unit to be moved to its closed position where the supply of the refrigerant at a high pressure from the discharge chamber to the crank chamber is stopped. The valve unit and the valve control mechanism constitute an integral displacement control valve unit.

When the compressor is operated under a first condition in which the valve unit of the displacement control valve unit is moved to its closing position to stop the supply of the refrigerant gas at a high pressure from the discharge chamber to the crank chamber, the refrigerant gas leaking from a compression chamber in the cylinder bore into the crank chamber, i.e., a blow-by refrigerant is withdrawn continuously from the crank chamber into the suction chamber via the fluid withdrawal passage. Thus, a reduction in the pressure in the crank chamber occurs. Subsequently, when a temperature in the objective area, i.e., a temperature in a vehicle compartment is lowered while reducing a refrigerating load, a suction pressure of the compressor is reduced. When a reduction in the pressure in the crank chamber is lowered to a level below the predetermined reference value, the valve unit of the displacement control valve unit is moved to its opening position. Therefore, a refrigerant at a high pressure is supplied from the discharge chamber into the crank chamber to increase a pressure in the crank chamber. When the pressure in the crank chamber is increased to go up beyond the predetermined value, the valve unit of the displacement control valve unit is moved to its closing position to close the aforementioned portion of the fluid supply passage. Therefore, the pressure increase in the crank chamber is stopped, and the pressure in the crank chamber is held substantially at the predetermined value during the ordinary operation of the compressor. A difference between the pressure in the crank chamber and the suction pressure of the compressor relying on a change in the refrigerating load of the climate control system adjustably changes the reciprocating stroke of the piston mechanism to thereby control the displacement of the compressor. Although the above-mentioned displacement control valve unit is arranged so as to control the opening and closing operation of the valve unit thereof in response to detection of a change in the pressure prevailing in the crank chamber, the controlling operation of the displacement control valve unit may be carried out in a different manner. For example, the displacement control valve unit may be constructed to operate in such a manner that the movement of the valve unit thereof to its open and closed positions is controlled in response to detection of a change in the suction pressure of the refrigerant compressor. Further, the displacement control valve unit may include a valve unit thereof arranged in a portion of the fluid withdrawal passage in the refrigerant compressor so as to control withdrawing of the refrigerant from the crank chamber into the suction chamber.

It should be noted that the above-mentioned displacement control valve unit is conventionally assembled in either a cylinder block or a rear housing of a variable displacement type refrigerant compressor. FIG. 4 typically illustrates a conventional control valve unit 20 assembled in a rear housing 3. The control valve unit 20 is provided with a suction pressure chamber 21 functioning as a pressure sensing chamber, and a discharge pressure chamber 22 arranged axially opposed to the suction pressure chamber 21 and functioning as a valve chamber. The suction pressure chamber 21 is arranged so as to communicate with the suction chamber 3*a* of the refrigerant compressor via a passage 23 formed in the rear housing 3, and the discharge pressure chamber 22 is arranged so as to communicate with the discharge chamber 3*b* of the refrigerant compressor via a passage 24 formed in the rear housing 3. Within the suction pressure chamber 21, a bellows element 26 is centrally arranged so as to axially expand or contract and to define therein an atmospheric chamber 25. A spring 27 is arranged so as to constantly urge the bellows element 26 toward its extended position, i.e., toward the discharge pressure chamber.

The discharge pressure chamber 22 has a valve hole 28 formed at an end thereof confronting the suction pressure chamber 21 so as to communicate with a valve port 29 which is arranged to communicate with the crank chamber 2*a* of the refrigerant compressor via a fluid supply passage 30. A valve rod 31 connected at its one end to the bellows element 26 extends toward the discharge pressure chamber 22 so that the other end thereof enters into the discharge pressure chamber 22 via the valve port 29 and the valve hole 28.

A valve element 32 is attached to the other end of the above-mentioned valve rod 31 within the discharge pressure chamber 22 so as to oppose to the valve hole 28. The valve element 32 is thus able to open and close the valve hole 28, in response to the expanding and contracting movement of the bellows element 26, and is constantly urged by the spring force of a spring 33 toward the closed position thereof to close the valve hole 28. Therefore, when the suction pressure introduced into the suction pressure chamber 21 goes down below a predetermined set value, the bellows element 26 is expanded to move the valve rod 31 so that the valve element 32 is moved away from the valve hole 28. Namely, the valve hole 28 is opened, and accordingly, the refrigerant gas at a discharge pressure (a high pressure) is supplied from the discharge chamber 3*b* into the crank chamber 2*a* via the valve hole 28, the valve port 29 and the fluid supply passage 30.

Nevertheless, the displacement control valve unit 20 is constructed so that the suction pressure chamber 21 in which the suction pressure Ps is introduced via the passage 23 to be sensed by the accommodated movable bellows element 26, the discharge pressure chamber 22 having two holes opening toward the fluid supply passage 30 and the discharge chamber 3*b* and accommodating therein the valve element 32 to open and close the valve hole 28, and the valve rod 31 transmitting the expanding and contracting movement of the bellows element 26 to the valve element 32 to thereby move the valve element 32, are integrally incorporated in a single member forming a casing member 34 of the displacement control valve unit 20 as shown in FIG. 3 and FIGS. 5A and 5B. Namely, the casing member 34 must be provided as an indispensable element of the displacement control valve unit 20, and the bellows element 26 must be seated on and welded to a seat 37 (37*a* or 37*b*) before the bellows element 26 is accommodated in the suction pressure chamber 21 of the casing member 34. Further, the casing member 34 of the valve control unit 20 must be provided with a plurality of grooves to contain therein o-rings 35 in order to fixedly disposed in an assembling bore of the rear housing 3 (or the cylinder block 1) when the control valve unit 20 is assembled in a compressor body. As a result, a large assembling space is needed to accommodate the control valve unit 20 in the body of the refrigerant compressor. In addition, the assembling of the control valve unit 20 requires delicate assembling operation performed by an operator and thus, causes an increase in the manufacturing cost.

Furthermore, since the bellows element 26 functioning as the pressure sensing element is a movable element permitted to expand and contract over a range of only 1 through 2 millimeters, the whole length of the casing member 34, the position to dispose the bellows element 26 within the suction pressure chamber 21, the bore depth in the casing member 34 which forms the suction pressure chamber 21 and the discharge pressure chamber 22 must be formed by machining at a very high accuracy to minimize a cumulative error due to addition of dimensional tolerances of the machined portions of the casing member 34.

SUMMARY OF THE INVENTION

An object of the present invention is therefore to solve the described many problems encountered by the conventional control valve unit assembled in the body of a variable displacement type refrigerant compressor.

Another object of the present invention is to provide a variable displacement type refrigerant compressor incorporating a novel valve control unit assembled in a simple assembling operation.

A further object of the present invention is to provide a valve control unit capable of being produced and assembled in a relatively small mounting space formed in a body of a variable displacement type refrigerant compressor at a low manufacturing cost, and with a high production accuracy.

A still further object of the present invention is to provide a method of assembling the above-mentioned novel valve control unit into a body of a variable displacement type refrigerant compressor.

In accordance with one aspect of the present invention, there is provided a variable displacement refrigerant compressor including a compressor housing forming an outer framework and provided internally with a compressing mechanism for compressing a refrigerant, a displacement varying mechanism for adjustably varying an amount of the refrigerant compressed and discharged by the compressing mechanism, and a displacement control valve unit adjustably controlling the operation of the displacement varying mechanism due to detecting a change in a pressure acting thereon, wherein the compressor housing is provided with a pressure sensing chamber for receiving a pressure to be detected and a valve chamber forming a fluid passage through which the refrigerant at a high pressure is permitted to flow to be used for changing a compressor displacement, the pressure sensing and valve chambers being bored in the compressor housing, and wherein the displacement control valve unit comprises: a pressure sensing mechanism arranged in the pressure sensing chamber and having a movable element moving in response to detection of a change in a pressure prevailing in the pressure sensing chamber; and a valve element arranged in the valve chamber and operating to open and close a port in the fluid passage according to the movement of the movable element of the pressure sensing mechanism.

Preferably, the compressor housing is further provided internally with a plurality of cylinder bores, a suction chamber, a discharge chamber, and a crank chamber, and the refrigerant compressor is further provided with a drive shaft rotatably supported by the compressor housing, a cam plate arranged in the crank chamber to be rotatable together with the drive shaft and permitted to vary an angle of inclination thereof with respect to a reference plane, and a plurality of pistons operatively engaged with the cam plate and reciprocating in the plurality of cylinder bores, the cam plate being arranged to change the angle of inclination thereof, on the basis of a difference between a first pressure prevailing in the crank chamber and a second pressure prevailing in the plurality of cylinder bores to thereby constitute the above-mentioned displacement varying mechanism.

Further preferably, the fluid passage is provided as a fluid supply passage extending between the discharge chamber and the crank chamber to supply the refrigerant at a discharge pressure from the discharge chamber to the crank chamber.

The compressor housing of the variable displacement type refrigerant compressor preferably may have a first and second ends opposite to one another along a predetermined axis, and the pressure sensing chamber is formed by a first bore bored from the first end while valve chamber is formed by a second bore bored from the second end. Further, a third bore is formed between the first and second bores so as to permit a valve rod to be movably inserted therein so that the valve rod transmits the movement of the pressure sensing mechanism to the valve element.

Preferably, the valve chamber formed in the compressor housing is provided with a valve seat formed as a separate element from the compressor housing and fixedly disposed in the valve chamber to cooperate with the valve element.

The pressure sensing mechanism preferably includes a bellows element having a flange portion formed at one end thereof and fixedly sandwiched between a shoulder portion formed in the compressor housing and a fixing means cooperating with the shoulder portion. The other end of the bellows element opposite to the above-mentioned end having the flange portion preferably has a reduced diameter projection functioning as a guide portion, and the guide portion is fitted in a guide recess formed in the pressure sensing chamber so that the bellows element stably expands and contracts under the guidance of the guide portion of the bellows element in the guide recess.

In accordance with another aspect of the present invention, there is provided a method of assembling a displacement control valve unit in a variable displacement type refrigerant compressor including a compressor housing having internally a compressing mechanism for compressing a refrigerant, and a displacement varying mechanism for adjustably varying an amount of the refrigerant compressed and discharged by the compressing mechanism, wherein the method comprises the steps of:

boring, in the compressor housing, a pressure sensing chamber to receive a pressure to be detected, a valve chamber provided to form a fluid passage through which the refrigerant at a high pressure is permitted to flow to be used for changing a compressor displacement, and a valve rod bore extending between the pressure sensing chamber and the valve chamber;

inserting a valve unit in the valve chamber at a position operable to open and close a port in the fluid passage;

inserting a pressure sensing mechanism in the pressure sensing chamber at a predetermined position where a movable element of the pressure sensing mechanism moving in response to detection of a change in a pressure prevailing in the pressure sensing chamber is operatively connected to the valve unit; and positioning the pressure sensing mechanism at the predetermined position in the pressure sensing chamber.

Preferably, the valve unit of the displacement control valve unit includes a valve element movable to open and close a valve port formed in said fluid passage, a valve seat having an opening thereof acting as the valve port in the fluid passage and cooperating with the valve element to open and close the valve port, and a valve rod arranged in the valve rod bore to engage the pressure sensing mechanism with the valve element, and the step of inserting the valve unit comprises:

preparing a jig tool provided therein with a recess formed to have a depth corresponding to a predetermined movement stroke of the movable element of the pressure sensing mechanism;

positioning the jig tool in the pressure sensing chamber so that the recess of the jig tool is in alignment with and in contact with one end of the valve rod bore, inserting the valve seat into the valve chamber at a position adjacent to a fixed position where the valve seat is press-fitted;

inserting the valve rod through the opening of the valve seat into the valve rod bore from the other end of said valve rod bore until one end of said valve rod is positioned adjacent to an end face of the recess of the jig tool placing the valve element in the valve chamber to be kept in contact with the valve seat; and pressing the valve seat and the valve rod, via the valve element, into the valve chamber until the valve rod comes in tight contact with the end face of the jig tool to thereby press-fit the valve seat at the fixed position in the valve chamber.

BRIEF DESCRIPTION OF THE DRAWINGS

The above and other objects, features, and advantages of the present invention will be made more apparent from the ensuing description of the preferred embodiments, with reference to the accompanying drawings wherein.

DESCRIPTION OF THE PREFERRED EMBODIMENTS

Figure 4:
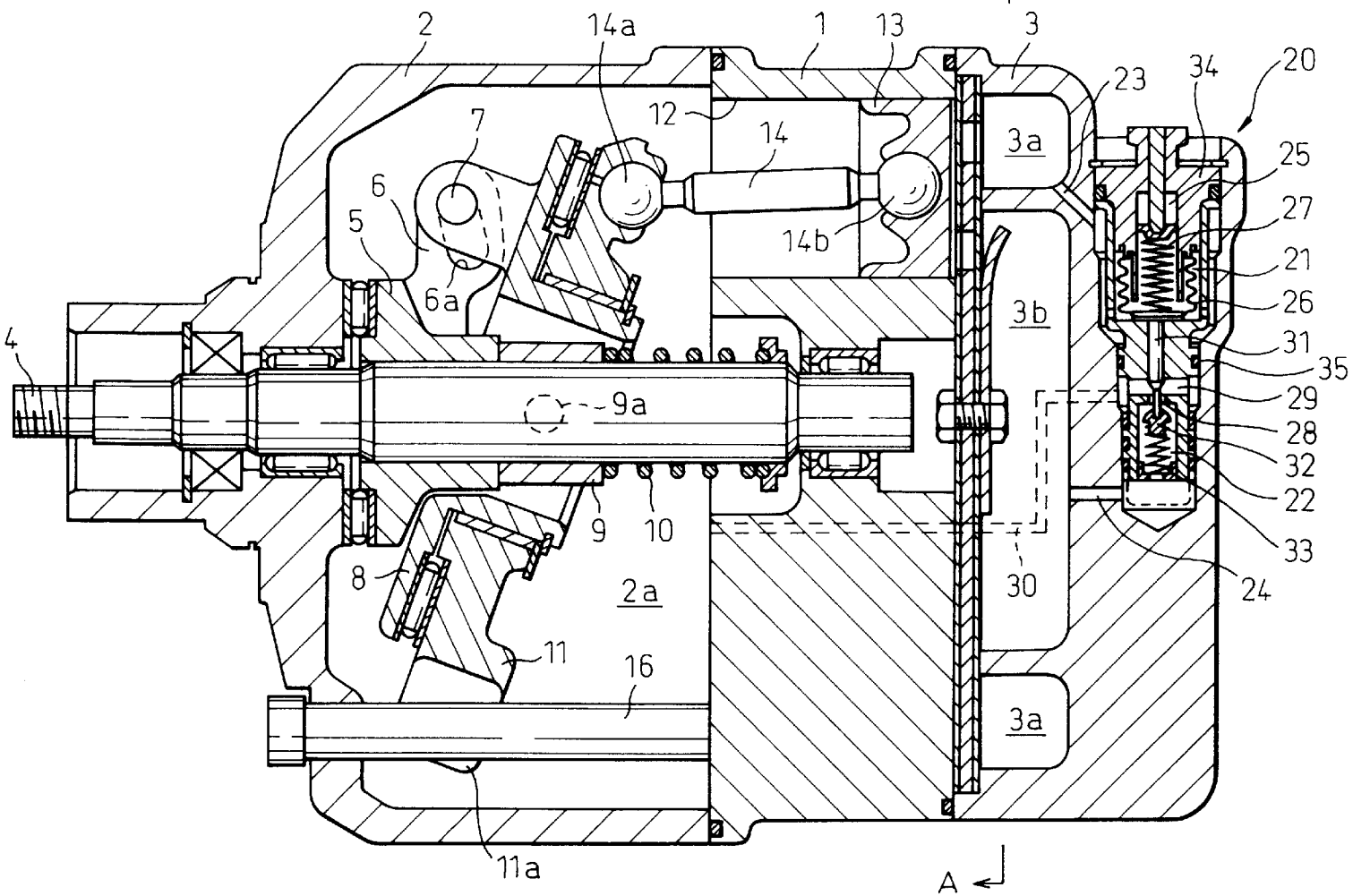
Fig. 4 (PRIOR ART)
FIG. 4 is a longitudinal cross-sectional view of a variable displacement type refrigerant compressor in which the conventional control valve unit is assembled.
Figure 5A:
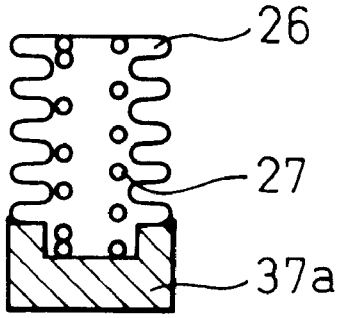
Fig. 5A (PRIOR ART)
FIG. 5A is a cross-sectional view of a portion of the conventional control valve unit, illustrating the pressure sensing bellows element welded to a seat member.
Figure 5B:
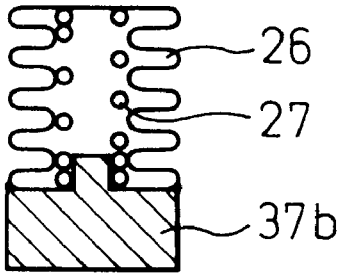
Fig. 5B (PRIOR ART)
FIG. 5B is a cross-sectional view of a portion of the conventional control valve unit, illustrating the pressure sensing bellows element welded to a seat member different from that of FIG. 5A.

Before starting the description of the preferred embodiment of the present invention, it should be understood that a portion of the variable displacement type refrigerant compressor, shown on the left of the line A—A of FIG. 4, illustrates a constructional portion common to a variable displacement type refrigerant compressor in which a displacement control valve unit according to the present invention is assembled and the compressor incorporates therein the conventional control valve unit 20. Therefore, the description of the compressor in which a displacement control valve unit 70 according to the present invention is assembled is provided hereinbelow with reference to FIG. 4.

In FIG. 4, the variable displacement type refrigerant compressor is provided with a cylinder block 1, which forms a part of an outer framework of the compressor. The compressor is further provided with a front housing 2 which is attached to a frontmost end of the cylinder block 1 to define a crank chamber 2*a*, and a rear housing 3 attached to a rear most end of the cylinder block 1 to define a suction chamber 3*a* and a discharge chamber 3*b* therein. A drive shaft 4 is rotatably supported by the front housing 2 and the cylinder block 1 and axially extends through the crank chamber 2*a*. The cylinder block 1, the front housing 2, and the rear housing 3 constitute a compressor housing capable of functioning as an outer framework of the compressor. The compressor housing is made of an aluminum alloy from the viewpoint of light weight and easy machinability.

Within the crank chamber 2*a*, a rotary support element 5 is fixedly mounted on the drive shaft 4 to have a rearwardly extending support arm 6. The support arm 6 of the rotary support element 5 is provided with an extended aperture 6*a* in which a pin 7 connected to a rotary drive plate 8 is slidably fitted. The rotary drive plate 8 can function as a rotary cam plate or a rotary swash plate arranged inclinably around the drive shaft 4. The rotary cam plate 8 and a hinge mechanism formed by the support arm 6 of the rotary support element 5 and the pin 7 connected to the cam plate 8 constitute a displacement varying mechanism for varying a discharge amount of the compressor.

A sleeve element 9 is slidably fitted on the drive shaft 4 at a position adjacent to a rear end of the rotary support element 5 and is constantly urged toward the rotary support element 5 by a coil spring 10. The sleeve element 9 is provided with a pair of laterally projecting pivots 9*a* (only one is shown in FIG. 4) which are engaged in a pair of holes (not shown) formed in the rotary cam plate 8. Thus, the rotary cam plate 8 is supported by the sleeve element 9 and is able to turn about the pivots 9*a*, 9*a*.

The rotary cam plate 8 has a rear face and a rear boss portion on which a wobble plate 11 is non-rotatably mounted. A thrust bearing is interposed between the rear face of the rotary cam plate 8 and the wobble plate 11. The wobble plate 11 has an outer periphery in which a guide recess 11*a* is formed to be engaged with an axial through-bolt 16 inserted from a front side of the front housing 2 and fixed to the cylinder block 1. Thus, the wobble plate 11 is prevented from rotating together with the rotary cam plate 8, and is permitted to turn about the above-mentioned pivots 9*a*, 9*a* together with the cam plate 8.

The wobble plate 11 is engaged with a plurality of pistons 13 via respective connecting rods 14 having spherical ends 14*a* and 14*b*, respectively. The pistons 13 are slidably fitted in the plurality of axial cylinder bores 12 formed in the cylinder block 1. Therefore, when the drive shaft 4 is rotated by an external drive power, the rotation of the drive shaft 4 is converted into a wobbling motion of the wobble plate 11 via the rotary cam plate 8, and the wobbling motion of the wobble plate 11 causes a reciprocating motion of the respective pistons 13 in the corresponding cylinder bores 12. When the plurality of pistons 13 reciprocate within the cylinder bores 12, a refrigerant gas is sucked from the suction chamber 3*a* into the cylinder bores 12 to be compressed by the respective pistons 13 within the compression chambers in the respective cylinder bores 12 and is discharged from the cylinder bores 12 into the discharge chamber 3*b*. During the refrigerant compressing operation of the compressor, the reciprocating stroke of the respective pistons 13 within the cylinder bores 12 and an angle of inclination of the cam and wobble plates 8 and 11 are adjustably changed by a change in a differential between a first pressure prevailing in the crank chamber 2*a* and a second pressure acting on the working heads of the respective pistons 13. Thus, the amount of discharge of the compressed refrigerant, i.e., the displacement of the compressor is adjustably changed. The pressure prevailing in the crank chamber 2*a* is controlled by a displacement control valve unit 70, which will be described with reference to FIGS. 1 and 2.

Further, it should be understood that the crank chamber 2*a* constantly communicates with the suction chamber 3*a* via a fluid withdrawal passage (not shown in FIG. 4).

Figure 1:
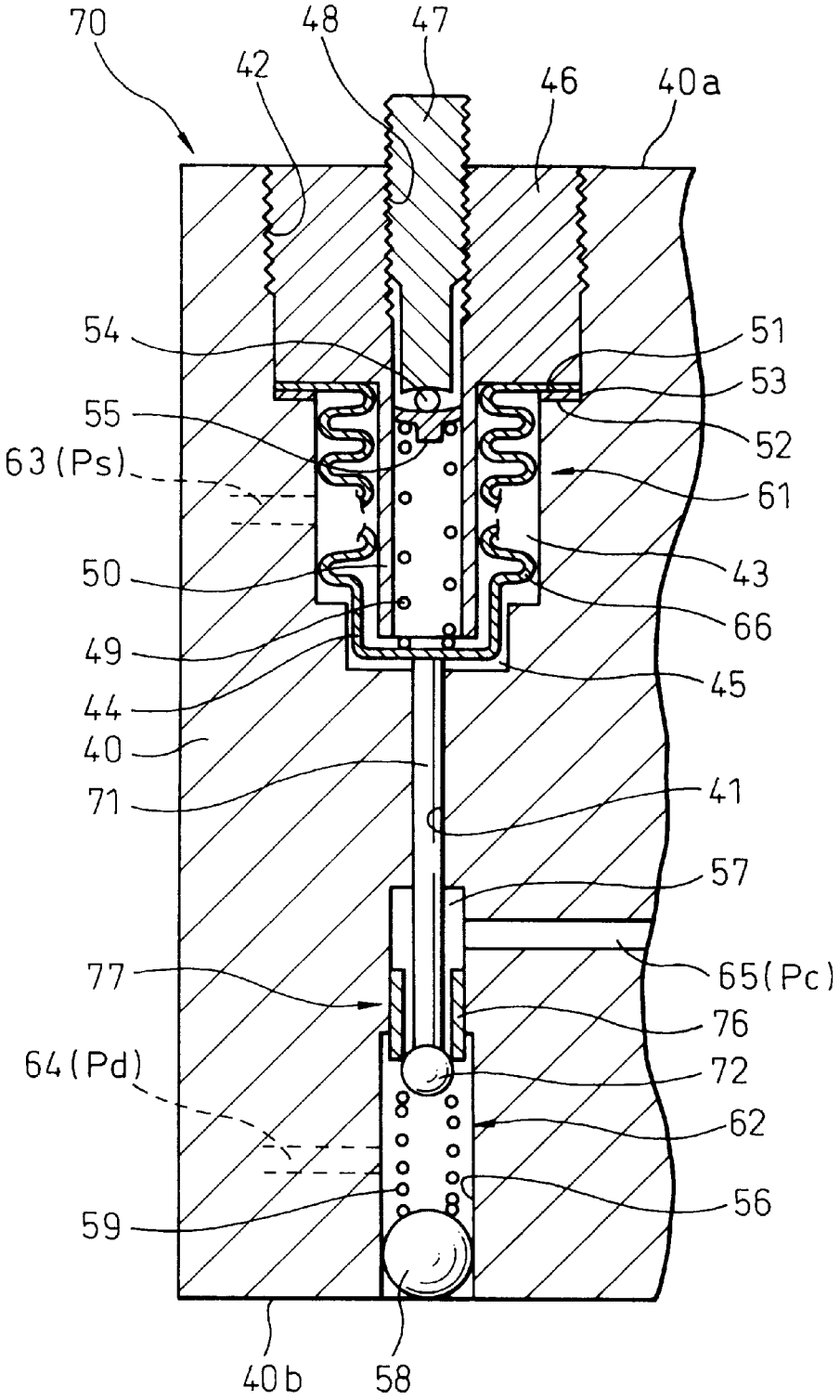
FIG. 1 is a cross-sectional view of a displacement control valve unit assembled in a compressor housing, according to an embodiment of the present invention.

Referring to FIG. 1, the displacement control valve unit 70 is assembled in a mounting area 40 appropriately defined in either the cylinder block 1 or the rear housing 3. The mounting area 40 is formed to have a first side 40*a* and a second side 40*b*, which are preferably arranged to be axially opposite to one another. The displacement control valve unit 70 is provided with a suction pressure chamber 61 formed as an axial bore drilled from the first side 40*a*, and the suction pressure chamber 61 can function as a pressure sensing chamber. The displacement control valve unit 70 is also provided with a discharge pressure chamber 62 which can function as a valve chamber and is formed as a bore coaxial with and axially opposed to the suction pressure chamber 61. The coaxial suction and discharge pressure sensing chambers 61 and 62 are connected by an axial bore which is also coaxial with the above-mentioned two chambers 61 and 62 and functions as a valve rod bore 41 in which a valve rod 71 is slidably fitted.

The suction pressure chamber 61 of the displacement control valve unit 70 includes a large diameter bore 42 having screw threads formed at an upper portion thereof so as to permit a fixing screw 46 is threadedly engaged. The suction chamber 61 is also provided with a coaxial middle diameter bore formed as a bellows-receiving chamber 43 for receiving a bellows element 66 which functions as a pressure-sensing element. The bellows receiving chamber 43 is continuous with the upper large diameter bore 42 and is formed to fluidly communicate with the suction chamber 3*a* via a fluid passage 63. Thus, a suction pressure Ps prevails in the bellows-receiving chamber 43, when the valve unit 70 is completely assembled, so as to be sensed by the bellows element 66. The suction pressure sensing chamber 61 is further provided with a reduced diameter bore functioning as a guide bore 45 in which a cylindrical guide projection 44 formed in a closed end of the bellows element 66 is received and guided during the expanding and contracting movement of the bellows element 66.

The fixing screw 46 is provided with a rear end portion having screw threads formed at an outer circumference thereof, and accordingly, the fixing screw 46 can be threadedly engaged in the screw threads of the large diameter bore 42 of the suction pressure sensing chamber 61. The fixing screw 46 is provided with a central bore 48 having a partly threaded portion with which a later-described adjusting screw 47 is engaged. The fixing screw 46 is further provided with a tubular spring holder portion 50 which extends coaxially with the central bore 48 and holds therein a coil spring 49.

The bellows element 66 is provided with the aforementioned cylindrical guide projection 44 at one closed end thereof and a flange portion 51 formed at the periphery of the opposite open end thereof. When the bellows element 66 is inserted in the bellows receiving chamber 43, the guide projection 44 is received in the guide bore 45. The flange portion 51 of the bellows element 66 is formed to be loosely fitted in the upper large diameter bore 42 and is seated on a shoulder portion 52 formed between the upper large diameter bore 42 and the bellows receiving chamber 43 via an appropriate gasket member 53. Thus, when the fixing screw 46 is threadedly engaged in the upper large diameter bore 42, the flange portion 51 is fixed to the shoulder portion 52.

When the fixing screw 46 is engaged in the upper large diameter bore 42, the tubular spring holder portion 50 is inserted in the interior of the bellows element 66, and a coil spring 49 is held in the tubular spring holder portion 50 of the fixing screw 46. An upper end of the coil spring 49 is engaged with a washer member 55 which is engaged with the adjusting screw 47 via a ball member 54. A lower end of the coil spring 49 is pressed against an inner face of the guide projection 44 of the bellows element 66 so that a spring force is applied to the bellows element 66 in a direction in which the bellows element 66 expands.

The discharge pressure chamber 62 formed by boring from the second side 40*b* of the mounting area 40 is provided with an aperture opening toward a fluid passage 64 which extends toward the discharge chamber 3*b* of the rear housing 3. Thus, the discharge pressure chamber 62 fluidly communicates with the discharge chamber 3*b*. The discharge pressure chamber 62 includes a valve operating chamber 56 in which a discharge pressure Pd is introduced from the discharge chamber 3*b* and an innermost valve seat chamber 57 in which a valve seat 76 is inserted and fixed. The valve seat chamber 57 has a port opening toward a fluid passage 65 communicating with the crank chamber 2*a*. Thus, a crank pressure Pc is introduced from the crank chamber 2*a* into the valve seat chamber 57. A valve element 72 is held in the valve operating chamber 56 of the discharge pressure chamber 62 and is constantly urged toward the valve seat 76 by a spring 59 having one end engaged with the valve element 72 and the other end engaged with a ball-like lid member 58. Thus, the valve element 72 and the valve seat 76 constitute a valve mechanism 77 which controls fluid communication between the discharge chamber 3*b* and the crank chamber 2*a* via a fluid supply passage formed by the fluid passage 64, the valve operating chamber 56, the valve seat chamber 57 and the fluid passage 65. Accordingly, the valve mechanism 77 controls a supply of the refrigerant at a high discharge pressure from the discharge chamber 3*b* to the crank chamber 2*a*.

The valve seat 76 is a tubular member made of a brass material and having an inner bore permitting a valve rod 71 to extend therethrough. The valve seat 76 is inserted in the valve operating chamber 56 of the discharge pressure chamber 62 and is press-fitted in position in the valve seat chamber 57.

Figure 2:
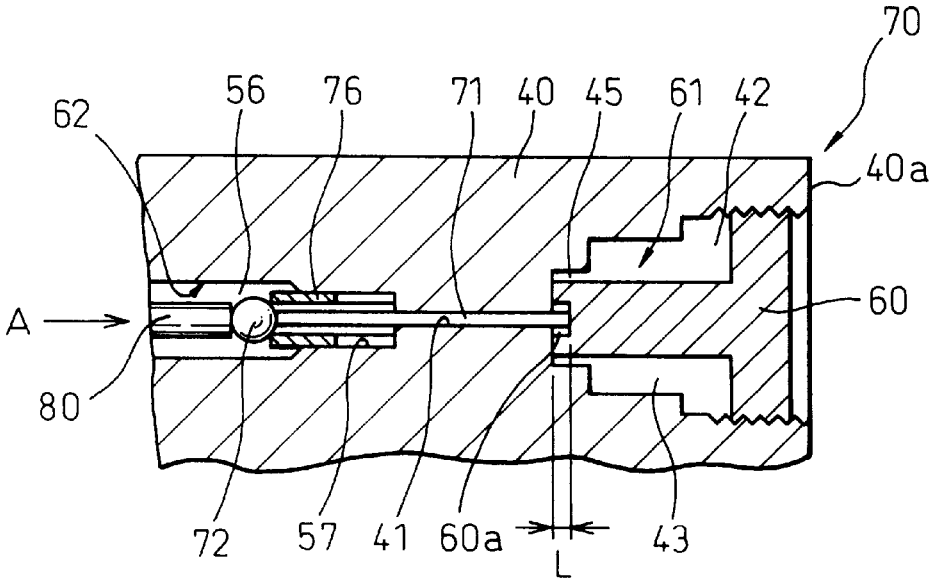
FIG. 2 is a schematic view for explaining of a method of assembling the displacement control valve unit into the compressor housing according to the present invention.
Figure 3:
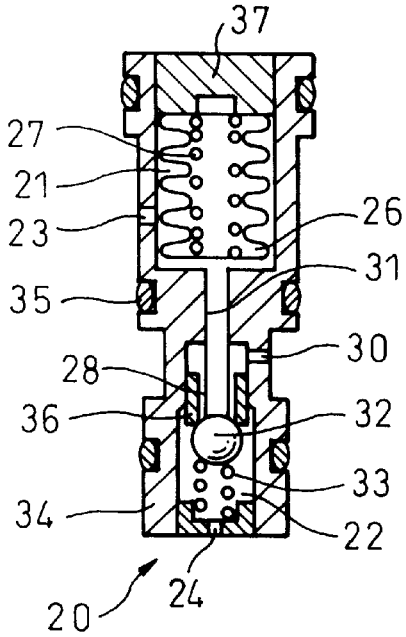
Fig. 3 (PRIOR ART)
FIG. 3 is a cross-sectional view of a conventional control valve unit incorporated in a variable displacement type refrigerant compressor.

When the valve seat 76 is press-fitted in the valve seat chamber 57, a specified jig tool 60 shown in FIG. 2 is used. Namely, as shown in FIG. 2, the jig tool 60 is provided with a central recess 60*a* formed at an extreme end thereof to have an axial depth corresponding to a predetermined amount of movement "L" of the bellows element 66. The jig tool 60 is inserted in the upper large diameter bore 42, so that the extreme end thereof having the above-mentioned recess 60*a* is pressed against the bottom of the upper large diameter bore 42 and that the central recess 60*a* is in alignment with the valve rod bore 41. The jig tool 60 is fixed in the upper large diameter bore 42, due to the threaded engagement between the jig tool 60 and the threaded portion of the bore 42. Subsequently, the valve rod 71 having the valve element 72 at one end thereof is inserted through the bore of the valve seat 76 and the valve rod bore 41 until the other end of the valve rod 71 comes close to the bottom end face of the recess 60*a* of the jig tool 60. At this time, the valve element 72 is held to be in contact with an end of the valve seat 76.

Then, the valve element 72 is tapped by an appropriate rod-like tool 80 in a direction shown by an arrow "A" until the other end of the valve rod 71 comes into contact with the bottom end face of the recess 60*a* of the jig tool 60. When the valve rod 71 comes into contact with the jig tool 60, the valve seat 76 is assembled and fixed in position in the valve seat chamber 57 of the discharge pressure chamber 62 via the valve element 72. Namely, the valve element 72 and the valve seat 76 are set in position ready for accurately opening and closing a valve port in the end of the valve seat 76, in response to a control movement of the pressure sensing means including the bellows element 66. Finally, the urging spring 59 and the ball-like lid 58 are assembled in the valve operating chamber 56 to press the valve element 72 against the valve seat 76 on the basis of a predetermined spring force of the urging spring 59.

Further, the jig tool 60 is removed from the upper large diameter bore 42 of the pressure sensing chamber 61, in order to assemble the pressure-sensing mechanism including the bellows element 66, the coil spring 49, the fixing screw 46, and the adjusting screw 47 in the pressure sensing chamber 61.

The operation of the above-described displacement control valve unit 70 of the present embodiment will be described hereinbelow with reference to FIGS. 1 and 4.

In the present embodiment, the displacement control valve unit 70 is arranged so as to perform a controlling operation on the basis of detecting the suction pressure Ps of the compressor. Namely, the valve unit 70 controls the crank pressure Pc in the crank chamber 2*a* in response to detection of a change in the suction pressure Ps. More specifically, when the refrigerating load applied from an external refrigerating system to the refrigerant compressor is large to generate a high suction pressure Ps, the high suction pressure Ps is introduced into the suction pressure chamber 61 via the fluid passage 63. Thus, the bellows element 66 contracts due to the high suction pressure Ps, so that the valve element 72 is pulled via the valve rod 71 to be pressed against the valve seat 76 and closes the valve port of the valve seat 76. Therefore, a fluid communication between the valve operating chamber 56 and the valve seat chamber 57 is stopped to interrupt a fluid communication between the discharge chamber 3*b* and the crank chamber 2*a*. Since the crank chamber 2*a* constantly communicates with the suction chamber 3*a* via the fluid withdrawal passage, the crank pressure Pc in the crank chamber 2*a* is lowered to a level equivalent to the suction pressure Ps. As a result, the rotary cam plate 8 rotating together with the drive shaft 4 is turned about the pivots 9*a*, 9*a* to take a maximum angle of inclination with respect to a reference plane perpendicular to the axis of rotation of the drive shaft 4. Therefore, the amount of discharge of the compressed refrigerant is kept at a maximum.

When the refrigerating load is reduced to generate a low suction pressure Ps, the low suction pressure Ps is introduced into the suction pressure chamber 61 of the displacement control valve unit 70 to permit the bellows element 66 to be expanded. Thus, the valve rod 71 is pressed by the bellows element 66 so as to move the valve element 72 in a direction away from the valve seat 76 against the spring force of the urging spring 59. Thus, the valve element 72 opens the valve port of the valve seat 76 to establish a fluid communication between the discharge chamber 3*b* and the crank chamber 2*a* via the fluid passages 64 and 65 so that the compressed refrigerant at a high pressure Pd is supplied from the discharge chamber 3*b* to the crank chamber 2*a*. Therefore, the crank pressure Pc in the crank chamber 2*a* is increased. Accordingly, the rotating cam plate 8 together with the non-rotatable wobble plate 11 are turned about the pivots 9*a*, 9*a* toward its minimum angle of inclination while the suction pressure Ps is reduced. Consequently, the amount of the compressed refrigerant discharged from the compressor is reduced to the minimum.

It should be noted that, in the described displacement control valve unit 70 according to the present invention, the flange portion 51 of the bellows element 66 is fixedly sandwiched via the gasket 53 between the fixing screw 46 and the shoulder portion 52 in the suction pressure chamber 61. Thus, the bellows receiving chamber 43 forming the suction chamber 61 is completely sealed against the atmosphere. Further, the bellows element 66, fixed at its flange portion 51 to the shoulder portion 52, is permitted to expand and contract along a longitudinal direction by the guide of the guide bore 45, which constantly receives the cylindrical guide projection 44 of the bellows element 66. As the inner diameter of the bellows receiving chamber 43 is larger than the outermost diameter of the bellows element 66, the movement of the bellows element 66 can be always stable due to the guidance of the guide bore 45. The tubular spring holder portion 50 of the fixing screw 46 also contributes to the stable movement of the bellows element 66. The stable movement of the bellows element 66 is effective for preventing the bellows element 66 from contacting with the wall of the bellows-receiving chamber 43, and accordingly, the bellows element 66 can be prevented from being frictionally abraded.

In the displacement control valve unit 70 of the present embodiment, the valve seat chamber 57 of the discharge pressure chamber 62 is formed in the mounting area 40 (e.g., the rear housing 3) of the compressor made of aluminum alloy material. Nevertheless, the valve seat 76 is made of brass material, and is press-fitted in the valve seat chamber 57. Namely, the material of the valve seat 76 is selected to be hard enough to avoid physical deformation and abrasion due to contacting of the valve seat 76 with the valve element 72 which is also made of hard metallic material.

Further, since the important elements of the displacement control valve unit 70, i.e., the bellows element 66, the valve rod 71, the valve element 72, and the valve seat 76 are all assembled in the mounting area 40 of the compressor body by using the specific jig tool 60, these elements can be accurately assembled in the compressor body even if the mounting area 40, i.e., the rear housing 3 or the cylinder block 1 is rather roughly machined. Thus, the control operation of the displacement control valve unit 70 can be accurate.

The displacement control valve unit 70 according to the present invention does not have a valve casing, and a part of the compressor body is used as a casing of the valve unit 70. Further, no o-ring element is incorporated in the valve unit 70, and accordingly, production and assembly of the displacement control valve unit 70 can be easy and simple to reduce the manufacturing cost of the valve unit 70 per se and of the variable displacement type refrigerant compressor.

Although the described embodiment of the displacement control valve unit is assembled in a variable displacement type refrigerant compressor employing a combination of a swash plate-type cam plate and a wobble plate for a displacement varying mechanism, the valve unit may be equivalently used with many different variable displacement type refrigerant compressors such as a variable capacity refrigerant compressor as disclosed in U.S. Pat. No. 5,873,704 to Ota et al., which has a single plate-like cam plate engaged with a plurality of single-headed pistons via shoes, a rotary type variable displacement refrigerant compressor including a vane type refrigerant compressor and a scroll type refrigerant compressor.

It should be understood that many and various changes and modifications to the described embodiment of the present invention will occur to a person skilled in the art without departing from the scope and spirit of the present invention as claimed in the accompanying claims.

What we claim is:

1. A variable displacement refrigerant compressor comprising:

a compressor housing forming an outer framework and provided internally with a compressing mechanism for compressing a refrigerant;

a displacement varying mechanism for adjustably varying an amount of the refrigerant compressed and discharged by said compressing mechanism;

a displacement control valve unit adjustably controlling the operation of said displacement varying mechanism due to detecting a change in a pressure acting thereon;

wherein said compressor housing is provided with a pressure sensing chamber for receiving a pressure to be detected and a valve chamber forming a fluid passage through which the refrigerant at a high pressure is permitted to flow to be used for changing a compressor displacement, said pressure sensing chamber and said valve chamber being bored in said compressor housing; and wherein said displacement control valve unit comprises:

a pressure sensing mechanism arranged in said pressure sensing chamber and having a movable element moving in response to detection of a change in a pressure prevailing in said pressure sensing chamber, wherein said pressure sensing mechanism has an end portion that is sandwiched between a fixing means and said compressor housing; and a valve element arranged in said valve chamber and operating to open and close a port in said fluid passage according to the movement of said movable element of said pressure sensing mechanism.

2. A variable displacement refrigerant compressor according to claim 1, wherein said port in said fluid passage is provided in a valve seat arranged in said fluid passage to cooperate with said valve element.

3. A variable displacement refrigerant compressor according to claim 2, wherein said valve seat is formed as a tubular member having an inner bore permitting a valve rod to extend therethrough, wherein said valve scat is formed separate from and fixedly assembled in said compressor housing.

4. A variable displacement refrigerant compressor according to claim 3, wherein said tubular member of said valve seat is made of a metallic material harder than that of which said compressor housing is made.

5. A variable displacement refrigerant compressor according to claim 3, wherein said port is a bore end of said tubular member of said valve seat, and wherein said valve element comprises a spherical element operable to open and close said bore end of said tubular member.

6. A variable displacement refrigerant compressor according to claim 1, said refrigerant compressor further comprising:

a plurality of cylinder bores, a suction chamber, a discharge chamber, and a crank chamber which are formed in said compressor housing;

a drive shaft rotatably supported by said compressor housing;

a cam plate arranged in said crank chamber to be rotatable together with said drive shaft and permitted to vary an angle of inclination thereof with respect to a reference plane;

a plurality of pistons operatively engaged with said cam plate and reciprocating in said plurality of cylinder bores, and wherein said cam plate is arranged to change the angle of inclination thereof, on the basis of a difference between a first pressure prevailing in said crank chamber and a second pressure prevailing in said plurality of cylinder bores to thereby constitute said displacement varying mechanism.

7. A variable displacement refrigerant compressor according to claim 6, wherein said fluid passage is provided as a fluid supply passage fluidly communicating said discharge chamber with said crank chamber.

8. A variable displacement refrigerant compressor according to claim 1, wherein said compressor housing is provided with a first and a second side opposite to one another along a predetermined axis, wherein said pressure sensing chamber is formed by a first bore bored from said first side while said valve chamber is formed by a second bore bored from said second side of said compressor housing, and wherein a third bore is formed between said first and second bores so as to permit a valve rod to be movably inserted therein so that said valve rod transmits the movement of said pressure sensing mechanism to said valve element.

9. A variable displacement refrigerant compressor according to claim 1, wherein said pressure sensing mechanism comprises a bellows element having a flange portion formed at one end thereof permitting to be fixedly sandwiched between a shoulder portion formed in said compressor housing and arranged adjacent to said pressure sensing chamber, and said fixing means cooperating with said shoulder portion for fixing said flange portion of said bellows element.

10. A variable displacement refrigerant compressor according to claim 9, wherein the other end of said bellows element opposite to said end having said flange portion has a reduced diameter projection functioning as a guide portion, and said guide portion being fitted in a guide recess formed in said pressure sensing chamber, so that said bellows element stably expands and contracts by the guide of the guide portion of said bellows element in the guide recess.

11. A variable displacement refrigerant compressor according to claim 1, wherein an opening of said compressor housing on a side provided with said pressure sensing mechanism is closed by said fixing means.

* * * * *